US006217114B1

(12) United States Patent
Degonda

(10) Patent No.: US 6,217,114 B1
(45) Date of Patent: Apr. 17, 2001

(54) STATIONARY OR WHEELED INCLINABLE SEAT ARRANGEMENT, IN PARTICULAR FOR THE SICK OR HANDICAPPED

(75) Inventor: André Degonda, Lausanne (CH)

(73) Assignee: Degonda-Rehab SA, Lausanne (CH)

( * ) Notice: Subject to any disclaimer, the term of this patent is extended or adjusted under 35 U.S.C. 154(b) by 0 days.

(21) Appl. No.: 08/875,920

(22) PCT Filed: Dec. 12, 1996

(86) PCT No.: PCT/CH96/00436

§ 371 Date: Aug. 11, 1997

§ 102(e) Date: Aug. 11, 1997

(87) PCT Pub. No.: WO97/23187

PCT Pub. Date: Jul. 3, 1997

(30) Foreign Application Priority Data

Dec. 21, 1995 (FR) ..... 95 15280

(51) Int. Cl.[7] ..... A47C 1/02

(52) U.S. Cl. ..... 297/325; 5/610; 280/250.1; 297/DIG. 4

(58) Field of Search ..... 297/326, 325, 297/DIG. 4, 328, 362.13, 183.7; 5/610, 617, 618; 280/250.1, 664, 717

(56) References Cited

U.S. PATENT DOCUMENTS

| | | | | |
|---|---|---|---|---|
| 2,696,207 | * | 12/1954 | Bushnell | 5/610 X |
| 2,986,200 | | 5/1961 | Nobile | 155/30 |
| 3,436,069 | * | 4/1969 | Henschen | 280/717 X |
| 3,687,479 | * | 8/1972 | Kober | 280/717 |
| 3,950,026 | | 4/1976 | Van Seenus | 297/328 |
| 4,555,121 | | 11/1985 | Lockard et al. | 280/30 |
| 4,643,446 | * | 2/1987 | Murphy et al. | 280/250.1 X |
| 4,652,026 | * | 3/1987 | Byrge | 280/250.1 |
| 4,679,849 | * | 7/1987 | Torgny | 280/250.1 X |
| 4,966,379 | * | 10/1990 | Mulholland | 280/250.1 X |
| 5,157,787 | * | 10/1992 | Donnellan et al. | 5/610 |
| 5,294,141 | * | 3/1994 | Mentessi et al. | 28/250.1 |

FOREIGN PATENT DOCUMENTS

| | | |
|---|---|---|
| 681 772 | 5/1993 | (CH) . |
| 85 01 722 | 6/1985 | (DE) . |
| 88 05 510 | 6/1988 | (DE) . |
| 2 693 889 | 1/1994 | (FR) . |
| 2 029 334 | 3/1980 | (GB) . |
| 92/08636 | 5/1992 | (WO) . |
| 96/15752 | 5/1996 | (WO) . |

* cited by examiner

*Primary Examiner*—Peter M. Cuomo
*Assistant Examiner*—Stephen Vu
(74) *Attorney, Agent, or Firm*—Griffin & Szipl, P.C.

(57) ABSTRACT

An inclinable seat arrangement, in particular for a sick or handicapped occupant, is described. It comprises a framework (2) and an inclinable seat (3) connected to the framework by an articulation (4) and by a positioning mechanism arranged so as to facilitate the manipulations for inclining the seat by the occupant or by another person. The axis of the articulation (4) is preferably located proximate a vertical line passing through the center of gravity (G1) of the occupant when in a position corresponding to the equilibrium position of the empty seat. An elastic mechanism, exerting a progressive return couple toward the equilibrium position, comprises elastic bearings (24) within the articulation. The elastic mechanism also preferably comprises a constant force gas thrustor (6) which includes a controlled blocking arrangement. In place of the gas thrustor there may be provided a motorized jack (51) controlled by the occupant (48). The seat arrangement may be employed in stationary or wheeled chairs for the sick or handicapped.

16 Claims, 3 Drawing Sheets

STATIONARY OR WHEELED INCLINABLE SEAT ARRANGEMENT, IN PARTICULAR FOR THE SICK OR HANDICAPPED

FIELD OF THE INVENTION

The present invention concerns an inclinable seat arrangement, in particular for a sick or handicapped occupant, comprising a framework arranged to rest on the ground, a seat mounted on the framework by means of at least one articulation with a horizontal transversal axis, so as to be inclinable within a range of inclined positions, and positioning means arranged so as to stabilize the seat in at least one of said positions whenever the seat supports the weight of the occupant, in which the positioning means include blocking means adapted to block the inclination of the seat in every position within said range and to be manually controlled, and elastic means coupling the seat to the framework and defining a no-load equilibrium position whenever the seat is not occupied, the elastic means being arranged to exert a return couple on the seat toward the no-load equilibrium position whenever the seat is in a position different therefrom, the return couple increasing as the seat moves away from said equilibrium position, and in which at least certain of said elastic means are associated with said articulation.

DESCRIPTION OF RELATED ART

Inclinable seat arrangements are known in which the inclination of the seat can be manually modified and blocked by means of an indexing notch mechanism. U.S. Pat. No. 2,986,200 shows for example an invalid's wheelchair in which the tilting articulation of the seat is associated with a blocking mechanism and with return springs which oppose the tilt-over couple produced by the weight of the occupant, in order to stabilize the seat and enable manoeuvring thereof with little effort. Nevertheless, such arrangements have not been of commercial importance since the springs must be relatively strong and do not permit the obtaining of a good concordance between the variation of the return couple and the variation of the couple due to the weight of the occupant. It is thus necessary to exert substantial force in order to place the seat in a position distant from the equilibrium position, or to return it thereto.

Patent application FR 2/693,889 describes a tilting armchair arrangement also having elastic means associated with the articulation in the form of a torsion spring and blocking means arranged at a distance from the articulation in the form of a fluid-containing cylinder the piston of which brakes the tilting and includes a blocking valve controlled by the occupant. When unblocked, the piston cannot contribute to the tilting of the seat, but simply opposes any rapid movement thereof. It results therefrom that the spring must be relatively strong, as in the previously mentioned prior art.

In general, in order to reduce the risk of an undesired tipping over of a seat of this nature, it is provided that the axis of articulation be placed in the neighbourhood of a vertical line passing through the centre of gravity of the occupant. The occupant may then control the movements of inclination by movements of his body, for example of the chest, in order to change the position of his center of gravity and thus produce tilting of the seat following unblocking. However, it is necessary that such movements of the body have a certain amplitude when the center of gravity is to pass from one side to the other of the support articulation. In such case, if they are easy enough for a person in sound health, they may be arduous, indeed impossible, for a sick or handicapped person. Additionally, premature unblocking or tardy unblocking of the blocking element may lead to brusque manoeuvres and incidents.

Swiss patent 681 772 shows an office chair with an inclinable seat mounted on an elastic articulation provided with rubber elements as well as an abutment in front and an abutment behind which limit the possible range of inclination. There is no means of blocking in intermediate positions. Such an arrangement is not applicable to a seat for the sick or handicapped. If it were to be adapted to such an application, it would require particularly strong and heavy elastic elements. Now economy in weight is an important criterion in the conception of a wheelchair, in particular one for manual propulsion.

For the rest, there is known through patent application GB 2,029,334 a type of inclinable seat arrangement in which the positioning means are formed by a manual or motorized actuator, for example a linear hydraulic, pneumatic or electric jack which controls the spread between two respective points of the framework and of the seat at a certain distance from the articulation axis. In order that a sick or handicapped occupant may himself modify the inclination of the seat, the actuator must be capable of functioning when the seat is occupied, thus be dimensioned in a manner to produce sufficient force in order to overcome the maximum couple resulting from the weight of the occupant in any position whatsoever of the seat. This influences the weight, the volume and the cost of the positioning means in a negative manner, as well as their energy consumption. If the actuator is manual, manoeuvres by a sick or handicapped occupant may prove quite difficult and taxing.

SUMMARY OF THE INVENTION

The present invention seeks to perfect an inclinable seat arrangement of the type indicated in the preamble in a manner to avoid the above-mentioned drawbacks of the prior art arrangements by facilitating the tilting manoeuvres of the seat with a simple construction as light as possible and inexpensive. According to a particular purpose of the invention, all the manoeuvres ought to be capable of being effected with relatively feeble efforts, whether the latter be exerted by the occupant himself, by another person or by motorized means.

To this end, a first aspect of the invention concerns an inclinable seat arrangement such as defined in the preamble, characterized in that the elastic means further comprise a gas thrustor arranged so as to exert a force between the framework and the seat at a distance from the articulation axis, said force being substantially constant, at least when the blocking means are unblocked.

Thus, it is possible to obtain through the combined action of the elastic means associated with the articulation and the force of the gas thrustor a return coupled which varies non-linearly with the inclination of the seat from the no-load or loaded equilibrium position. Effectively, the moment of the force from the gas thrustor can vary in the course of the tilting movements of the seat, because the distance between the articulation and the axis of the thrustor also varies. The respective anchor points of the gas thrustor on the framework and on the seat can be chosen in a manner to obtain the appropriate variation minimizing the effort necessary for the manoeuvre throughout the entire range of inclination. In general, the no-load equilibrium position will be located rather towards the front and preferably the gas thrustor will be arranged in a manner such that its force opposes tilting towards the rear where the couple due to the weight of the occupant is relatively great. Thus, the elastic means incorporated in the articulation may be less strong, less heavy and less expensive.

It must be noted that in the prior art illustrated by the documents U.S. Pat. No. 2,986,200 and FR 2 693 889 cited hereinabove the elastic means associated with the articulation exert a return couple which increases linearly with the inclination of the seat from the equilibrium position. To the contrary, the couple due to the weight of the occupant does not vary linearly, but according to a sine law relative to the inclination. This is why good correspondence between these two couples within the range of useful inclinations is not obtained with the arrangements of the prior art. The invention defined hereinabove enables overcoming this drawback by an appropriate choice of the anchor points of the gas thrustor.

Preferably, the blocking means are associated with the gas thrustor and arranged so as to block or unblock the latter on command, the gas thrustor being of a type of substantially constant force when unblocked. Since the gas thrustor serves at the same time as elastic means and blocking means, this represents an economy of material and weight. When it is blocked, the thrustor exerts the force of reaction necessary in order to maintain the seat in the chosen position.

The second aspect of the invention concerns an inclinable seat arrangement such as defined in the preamble, characterized in that the positioning means include a jack with a motorized drive arranged at a distance from the articulation axis, said jack coupling the framework to the seat in order to control the inclination of the seat and forming part of the blocking means.

In such an arrangement thus disposed, the combination of the elastic means associated with the articulation and of the motorized jack assuring at the same time the positioning and the blocking of the seat in any position whatsoever within the range of inclination, offers several advantages. Thanks to the elastic return couple, there can be employed a jack the force and the energy consumption of which are greatly reduced. This, thus, permits the fitting out of a stationary seat or a wheelchair with manual propulsion, the jack being for example an electric jack energized by a battery or a small accumulator incorporated in the arrangement according to the invention. On the other hand, the arrangement includes few components since the jack fulfils the two functions of positioning and blocking. These components can be simple, small, light and relatively inexpensive.

Preferably, the axis of articulation is located proximate a vertical line passing through the center of gravity of the occupant when the seat is in said no-load equilibrium position. The seat is preferably inclinable towards the front and towards the rear relative to the no-load equilibrium position.

In a preferred embodiment of the arrangement, the elastic means comprise at least one elastic bearing forming said articulation and including rubber elements arranged so as to produce at least a portion of the return couple.

Furthermore, it may be provided that the seat includes a baseplate mounted on the framework and a back support mounted in an inclinable manner on the baseplate by means of another articulation associated with elastic return means loading the back support.

In a particularly advantageous application of the invention, the arrangement is provided in the form of a wheelchair or of a push chair for the sick or handicapped. Preferably the framework includes two principal wheels arranged along a common central axis located proximate a vertical line passing through the common center of gravity of the arrangement and occupant, at least one directable front wheel located in front of the central axis and at least one rear safety roller arranged so as to bear on the ground, at least in case of tilting over of the arrangement towards the rear around the central axis. Said rear roller can advantageously be adjustable in height on the framework to which it is coupled by elastic return means adapted to press it onto the ground, at least when the arrangement tends to tilt over towards the rear around the central axis.

BRIEF DESCRIPTION OF THE DRAWINGS

Other characteristics and advantages of the present invention will appear from the following description of a preferred embodiment thereof presented by way of example having reference to the attached drawings.

DESCRIPTION OF PREFERRED EMBODIMENT

Figure 1:
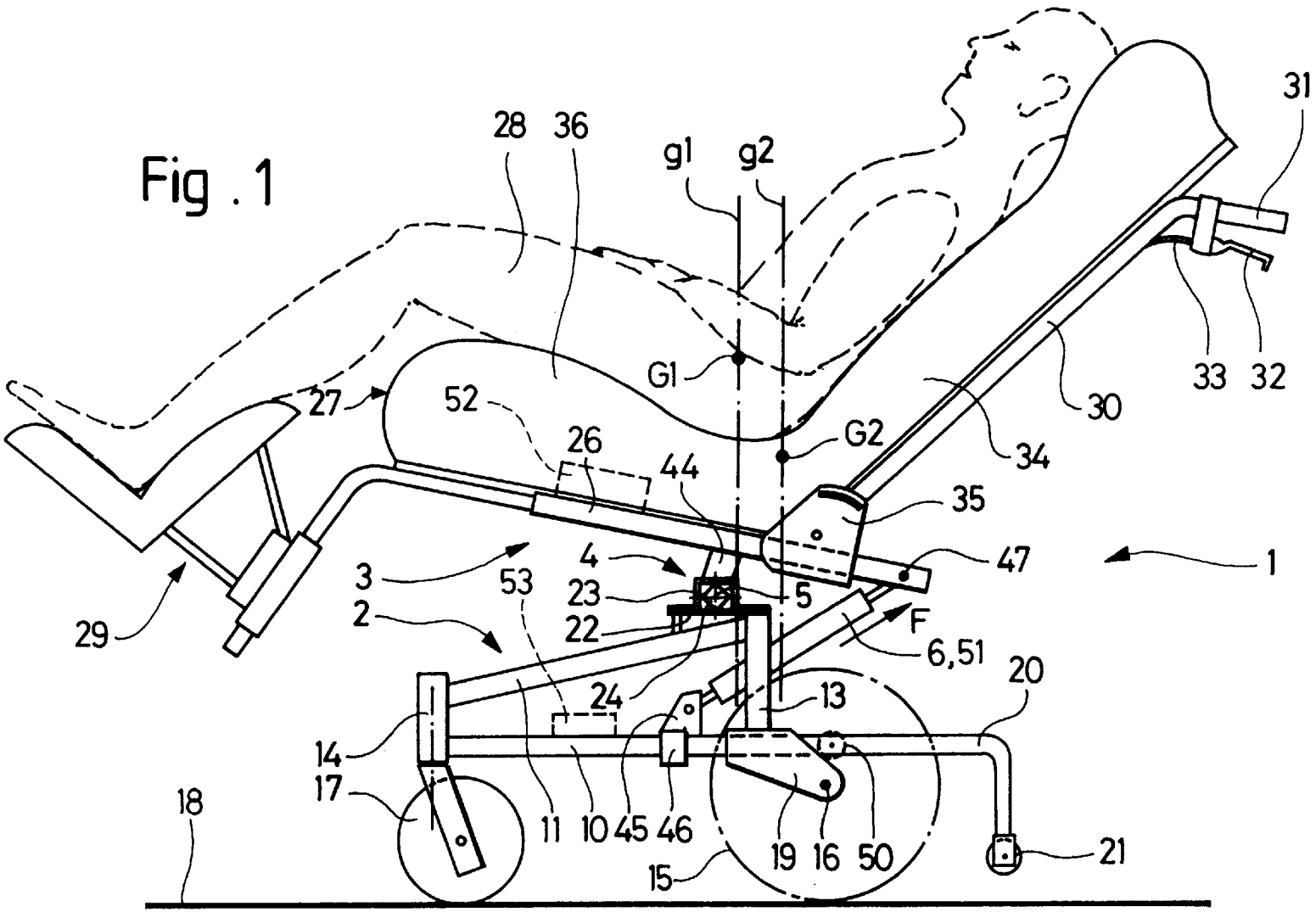
FIG. 1 is a lateral schematic view of an arrangement according to the invention, the seat of which is found in a loaded equilibrium position.
Figure 2:
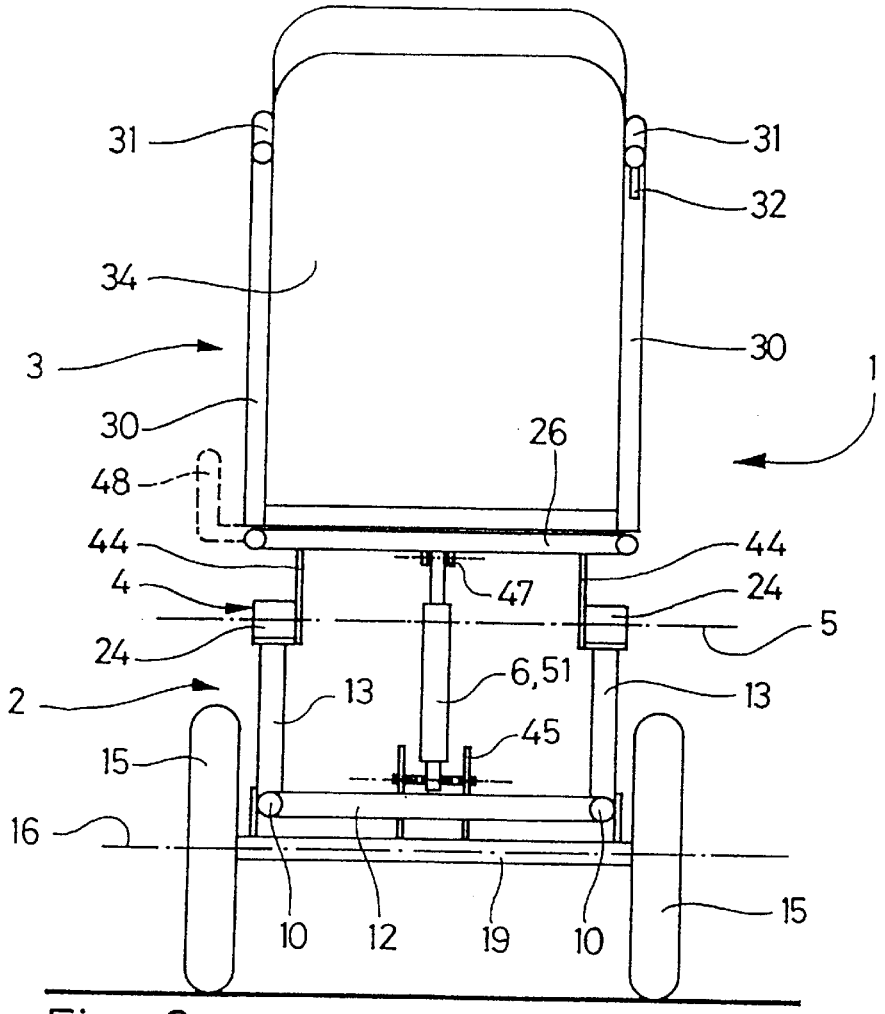
FIG. 2 is a schematic view from the rear of the arrangement.

The inclinable seat arrangement according to the invention such as it is shown on FIGS. 1 and 2 is embodied in the form of a push chair for the sick or handicapped. However, the same principle of construction could be applied to a stationary seat or to a wheelchair, whether the latter be propelled by the occupant himself or by a motorized drive incorporated in the chair.

The push chair 1 as shown includes a lower framework 2 and an inclinable seat 3 which are coupled by an articulation 4 with horizontal axis 5 and by a retaining element which, in the present case, is a gas thrustor 6 provided with an incorporated blocking arrangement.

The framework 2 principally includes a rigid chassis made up of longitudinal metallic tubes 10, 11, transversal tubes 12 and vertical tubes 13, 14, two principal side wheels 15 centered on a common transversal axis 16 and two front wheels 17 freely directable around a vertical axis, wheels 15 and 17 resting on the ground 18 in order to support the push chair assembly under normal conditions. The two principal wheels 15 are mounted on an axle 19 which is secured to the chassis, preferably in a longitudinally adjustable position. At the back, the framework 2 further includes two elbowed props 20, each bearing a rear security roller 21 which normally is found slightly above the ground 18, but which can bear thereon to prevent a possible tipping over of the chair towards the rear around axis 16 if front wheels 17 are lifted up for any reason whatsoever. In this example, the props 20 are fitted into the horizontal tubes 10 of the chassis where they are secured in a longitudinally adjustable position. It will be noted that framework 2, according to a variant, could include a single front wheel 17 and/or a single rear roller 21. It will also be noted that such a framework could be fitted out with a motorized driving system actuating the principal wheels 15 in the case of a motorized wheelchair. This framework could also be that of a manually driven wheelchair if the principal wheels 15 were arranged in view thereof, in particular with an annular hand grip within reach of the occupant's hand.

The chassis of framework 2 further includes two supports 22 on which are secured by means of metallic clamps 23, two pivoting elastic bearings 24, to be described hereinafter, and which are aligned on axis 5 in order to form together the articulation 4.

Seat 3 includes a rigid metallic chassis 26 supporting an upholstered chair 27 on which the occupant 28 may take his place. In front, chassis 26 bears an adjustable foot rest 29. At the back, it bears two inclined arms 30 provided with handles 31 in order to permit an auxiliary person to displace and direct the push chair 1. One of the handles 31 is provided with a hand grip 32 which controls, for example, the unblocking of the gas thrustor 6 thanks to a cable transmission 33. Preferably, the arms 30 are fixed to the back rest 34 of the chair 27 and are mounted on the chassis 26 by means of a pair of articulations 35 enabling adjustment of the inclination of the back rest relative to the baseplate 36 of the chair. Such articulations can also include elastic return means, for example elastic elements analogous to those of the bearings 24. In order to permit readjustment of the position of the center of gravity of the seat and of the occupant as a function of the position of the back rest, there may be provided a longitudinal translation arrangement of the chassis 26 relative to the articulation 4, for example by means of a crank actuating a screw and nut mechanism.

Figure 3:
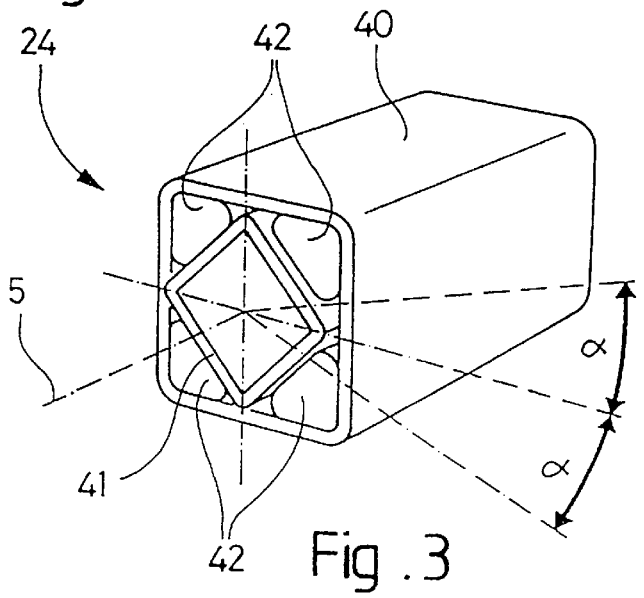
FIG. 3 shows in perspective an element forming an elastic bearing in the arrangement of FIGS. 1 and 2.
Figure 4:
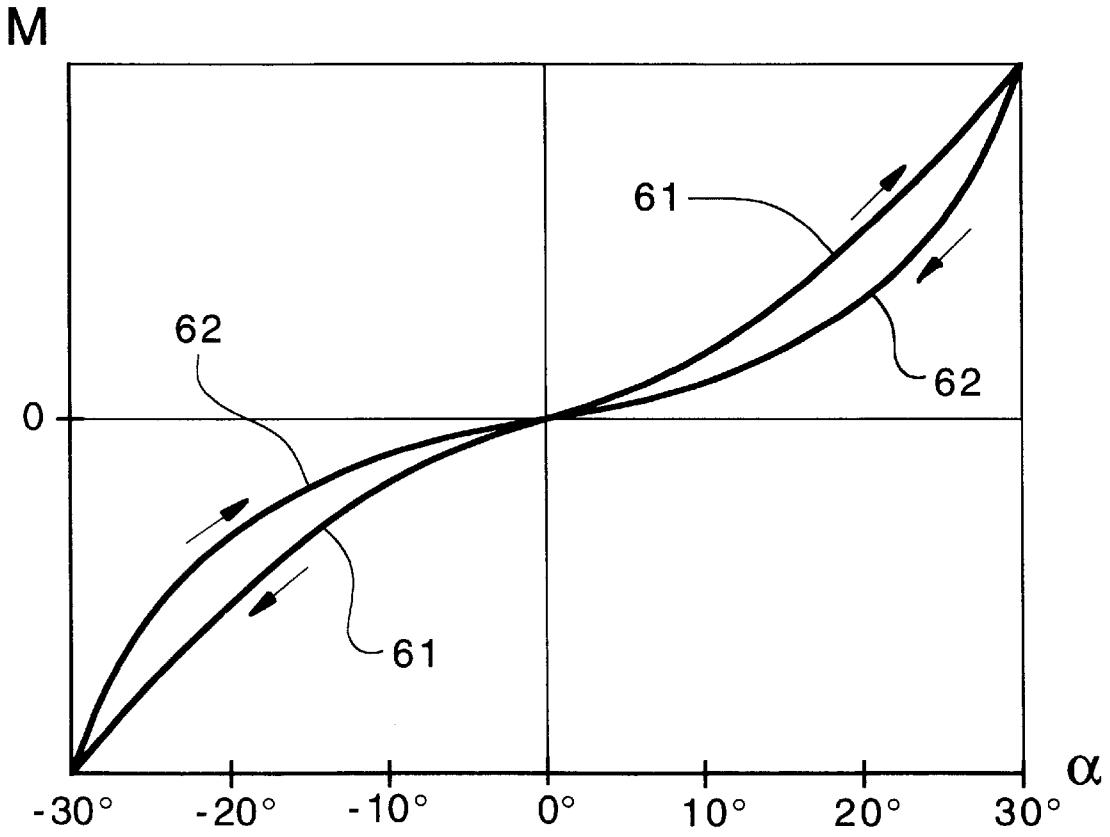
FIG. 4 is a schematic diagram showing a typical example of the characteristic curve of the pivoting couple-angle of an elastic bearing according to FIG. 3.

FIG. 3 shows the structure of one of the elastic bearings 24 forming the articulation 4. In this example, it concerns a ROSTA (registered trademark) elastic element of the type DR-S, manufactured by the company ROSTA-WERK AG in Hunzenschwil (Switzerland). This element includes a square outer tube 40 of steel, a square interior tube 41 likewise of steel arranged within the outer tube without touching it, and four prismatically formed blocks 42 of rubber having an approximately triangular cross-section. The blocks 42 are arranged in the corners of the outer tube 40 and each bears on a face of the interior tube 41 which in its rest position is rotated 45° relative to the outer tube 40, the blocks 42 being lightly compressed between the two tubes. When tube 40 is fixed, this assembly elastically supports the interior tube 41 in all directions and permits it to pivot from the rest position through an angle $\pm\alpha$ around an axis 5, such angle a being capable of reaching at least 30°. In the present case, one end of tube 41 of each elastic bearing 24 is secured to the chassis 26 of the seat by means of a metallic clamp 44. The rubber blocks 42 exert a return couple M on tube 41 which increases progressively with the angle $\alpha$. As shown on FIG. 4, this progression is not linear, the variation of the couple M being relatively small for the smaller values of the angle $\alpha$ and considerably higher when the angle becomes greater. Furthermore, the stress-strain diagram of the rubber blocks exhibits a hysteresis which is translated by a spread between the loading curve 61 and the unloading curve 62 in FIG. 4. Thus, the elastic bearing 24 also constitutes a shock absorber for all the vibrations of one tube 40, 41 relative to the other, in translation as well as in rotation.

In the embodiment described here, the thrustor 6 is a gas spring of constant force and automatic blocking of the type BLOC-O-LIFT (trademark) manufactured by the company STABILUS in Koblenz (Germany). When it is unblocked, it exerts a constant thrusting force F of 500 N. Its lower end is hinged on a support 45 fixed to a transverse beam 46 secured to the tubes 10 of the chassis in an adjustable position. Its upper end is hinged at 47 to a rear end of the chassis 6 of the seat.

Since the thrustor 6 is always found at a certain distance from the articulation axis 5, its force produces a permanent couple which tends to return the seat to an upright position. When the latter is not occupied, such couple causes the seat to swing towards the front and the elastic bearings produce an increasing resistance couple until the two couples are balanced, thus defining a no-load equilibrium position of the seat. This position is adjustable, in particular by displacing the transverse beam 46 which also permits modifying the couple produced by the force F relative to the axis 5 of articulation 4.

It will be noted nevertheless that the gas thrustor 6 need not necessarily be provided with a blocking arrangement. The latter could be an element separate from the thrustor, for example in the form described in patent application FR 2,693,889. However, the combination described here has the advantage of uniting the two functions of return and of blocking in a single element which represents an improvement in weight and of space taken up.

Preferably, the position of the articulation 4 relative to seat 3 is such that when occupant 28 normally rests on the seat, a vertical line g1 passing through the center of gravity G1 of the occupant passes proximate the axis 5 of the articulation, at least when the seat is found in the position referred to as the no-load equilibrium position. In this position, the seat is preferably rather upright in order that the footrest 29 not be too high and that the occupant can easily sit down. It is then preferable that the vertical line g1 be found slightly behind the axis of articulation 5 so that it is sufficient to unblock the thrustor 6 in order that the seat be automatically inclined towards the rear under the effect of the couple produced by the weight of the occupant. If the thrustor 6 is maintained unblocked by means of the hand grip 32, the seat 3 is stabilized in a loaded equilibrium position in which the couple due to the weight of the occupant is counterbalanced by the couple resulting from the elastic elements 6 and 24. There results therefrom a loaded equilibrium position specific to each position of the occupant. In order to define another inclination position, it is sufficient to raise or lower the handles 31 and to release the lever 32 in order to block the thrustor 6 when the desired position is attained.

In a variant shown in dashed outline on FIG. 2, the unblocking control of thrustor 6 can also include a control handle 48 arranged on the seat 3 in a manner to be accessible to the occupant in order that the latter can himself manoeuvre the seat. This control replaces that of the hand grip 32 in the case of a wheelchair. When the occupant himself wishes to modify the inclination of seat 3, he modifies, if necessary, the position of his center of gravity G1 by displacing a portion of his body, for example in slightly advancing his head, his chest or an arm, if he wishes to tilt forwardly, and he unblocks the thrustor 6. The change in the couple due to his weight which results therefrom then produces the desired movement until the return couple of the elastic elements has changed sufficiently to maintain the seat in the new loaded equilibrium position, even if the vertical line g1 has not changed sides relative to the articulation axis 5. Consequently, even a weak or handicapped sick person can modify without effort the inclination of his seat.

In FIG. 1, it will be noted that the central axis 16 of the principal wheels 15 is located proximate a vertical line g2 passing through the common center of gravity G2 of the arrangement 1 and of the occupant 28, such vertical line being slightly in front of the axis 16 for every position of seat 3 in order that the front wheel 17 bear on the ground. Thus, it is easy to cause tilting of the assembly of arrangement 1 towards the rear, including its framework 2, around axis 16 in order to lift the front wheels when they must cross over an obstacle such as a threshold or the edge of a sidewalk.

Tilting is then stopped by the rear rollers 21. The arms 20 can also be mounted on framework 2 in an elastic manner, for example by means of ROSTA elastic elements analogous to those of the bearings 24 and forming an articulation 50 (FIG. 1) with a horizontal axis in a manner such that each roller 21 is movable in height on the framework according to a principle described in the patent application WO 96/15752 from the same applicant. In this case, rollers 21 can bear lightly on the ground, even in the normal position of the framework in conformity with FIG. 1 in which the front wheels 17 also touch the ground and their bearing force will increase if the assembly of the arrangement has a tendency to tilt over backwards. In combination with such a progressive elastic support of the rear roller or rollers 21, an inclinable seat according to the present invention permits using a change of inclination of the seat in order to displace easily the center of gravity of the occupant so as to produce a transfer of the load on the front wheels to the rear rollers or vice versa, in particular in order to benefit from the elasticity of the support on the rear rollers. For example, when the occupant of such a wheelchair, motorized or not, must go down a path with a steep slope, he can incline his seat towards the rear, on the one hand in order to compensate for the inclination of the framework towards the front by reason of the slope of the ground, and, on the other hand, in order to unload the front wheels and place a greater load on the principal wheels which are those on which he has the actuating means for the propulsion, the braking and the direction of his wheelchair. By further accentuating the inclination, he can even cause tilting over of the framework towards the rear in order to lift the front wheels, for example in order to cause them to pass over an obstacle. The potential energy thus accumulated in the return springs of the rear rollers 21 is reusable when the wheelchair is once again set upright, in particular in order to facilitate the climbing of the main wheels onto the obstacle. This phenomenon and its advantageous application are described in detail in the previously cited patent application.

The person skilled in the art will understand that if the gas thrustor 6 described hereinabove were replaced by a simple blocking element, that is to say if the constant thrust exerted by such thrustor were omitted, the return couple would then be produced solely by the elastic bearings 24. However, the thrustor 6 has the advantage of exerting a pre-stress on the elastic bearings from whence there results a stronger return couple as soon as the seat departs from its equilibrium position. Additionally, it will be recalled that the choice of the position of the thrustor 6 enables adjusting its distance from the articulation axis and thus modulating the couple produced by its force F.

Another variant consists in forming the articulation 4 by means of ordinary bearings, the return couple then being assured by one or several spring elements coupling the seat 3 to the framework 2, for example with a torsion spring associated with the articulation 4.

In the application to a motorized wheelchair, it is possible to replace the thrustor 6 described hereinabove by a linear or rotating motorized actuator, for example an electric jack 51 controlled by the occupant in order to modify and block any position of inclination whatsoever of seat 3. Such jack 51 also serves as blocking element which maintains the position of seat 3. In FIG. 1, there has been shown by way of indication a control housing 52 for jack 51 mounted on the seat 3 within reach of the hand of the occupant 28 and an electric battery 53 mounted on the framework 2 in order to energize jack 51. The housing 52 includes push-pieces or a hand lever in order to control the jack 51. Thanks to the elastic return means, such an actuator can have a reduced nominal force relative to known arrangements, which permits an improvement in weight, volume and the cost of manufacture as well as economies of energy of operation.

In another variant, not shown, the arrangement can be stationary and not provided with wheels. In this case, the framework 2 can be a simple baseplate resting on the ground, or generally any structure whatsoever apt to support seat 3 and articulation 4, for example in a medical or dental practice or in a vehicle.

What is claimed is:

1. An inclinable seat arrangement comprising a framework arranged to rest on the ground, a seat mounted on the framework by at least one articulation with a horizontal transverse axis so as to be inclinable in a range of inclined positions, and positioning means for stabilizing arranged so as to stabilize the seat in at least one of said positions when the seat supports the weight of the occupant, wherein said positioning means include manually controlled blocking means for blocking the inclination of the seat in every position within said range and elastic means for coupling the seat to the framework and defining a no-load equilibrium position when the seat is not occupied, the elastic means being arranged to exert a return couple on the seat toward the no-load equilibrium position whenever the seat occupies a position different from the equilibrium position, the return couple increasing as the seat is moved away from said equilibrium position, and wherein said elastic means comprise at least one elastic bearing forming said articulation and including rubber elements arranged to produce at least a part of said return couple, and wherein said elastic means further comprise a gas thrustor arranged to exert a force between the framework and the seat at a distance from the articulation axis, said force being substantially constant at least when the blocking means are unblocked.

2. The inclinable seat arrangement of claim 1, wherein the seat includes a sole plate mounted on the framework and a back support inclinably mounted on the sole plate by means for acting on the back support.

3. The inclinable seat arrangement of claim 1, wherein the blocking means are associated with the gas thrustor and arranged so as to block or unblock the gas thrustor upon command, and the gas thrustor exerts a substantially constant force when it is unblocked.

4. The inclinable seat arrangement of claim 3, wherein the seat includes a sole plate mounted on the framework and a back support inclinably mounted on the sole plate by another articulation associated with elastic return means for acting on the back support.

5. An inclinable seat arrangement in the form of a wheelchair for the sick or handicapped comprising; a framework arranged to rest on the ground, a seat mounted on the framework by at least one articulation with a horizontal transverse axis so as to be inclinable in a range of inclined positions, and positioning means for stabilizing the seat in at least one of said positions when the seat supports the weight of the occupant, wherein said positioning means include manually controlled blocking means for blocking the inclination of the seat in every position within said range, and elastic means for coupling the seat to the framework and defining a no-load equilibrium position when the seat is not occupied, the elastic means being arranged to exert a return couple on the seat toward the no-load equilibrium position whenever the seat occupies a position different from the equilibrium position, the return couple increasing as the seat is moved away from said equilibrium position, said elastic means comprise at least one elastic bearing forming said articulation and including rubber elements arranged to produce at least a part of said return couple, the positioning means comprise a jack with a motorized drive arranged at a distance from the axis of the articulation, said jack coupling the framework to the seat in order to control the inclination of the seat and forming part of the blocking means, the framework includes two principal wheels arranged along a common central axis located proximate a vertical line passing through the common center of gravity of the arrangement and of the occupant, at least one directable front wheel located ahead of the central axis, and at least one rear safety roller arranged so as to bear on the ground at least in the event of tipping over of the arrangement toward the rear about the central axis, and said rear roller is movable upwardly on the framework to which it is connected by elastic return means for pressing it onto the ground at least when the arrangement tends to tip over toward the rear about the central axis.

6. The inclinable seat arrangement of claim 5, wherein the seat is inclinable toward the front and toward the rear relative to the no-load equilibrium position.

7. The inclinable seat arrangement of claim 5, wherein the seat includes a sole plate mounted on the framework and a back support inclinably mounted on the sole plate by another articulation associated with elastic return means for acting on the back support.

8. The inclinable seat arrangement of claim 1, wherein the seat is inclinable toward the front and toward the rear relative to the no-load equilibrium position.

9. The inclinable seat arrangement of claim 1, wherein the seat includes a sole plate mounted on the framework and a back support inclinable mounted on the sole plate by another articulation associated with elastic return means for acting on the back support.

10. The inclinable seat arrangement of claim 1, in the form of a wheelchair for the sick or handicapped.

11. The inclinable seat arrangement of claim 8, wherein the framework includes two principal wheels arranged along a common central axis located proximate a vertical line passing through a common center of gravity of the arrangement and of the occupant, at least one directable front wheel located ahead of the central axis, and at least one rear safety roller arranged so as to bear on the ground at least in the event of tipping over of the arrangement toward the rear about the central axis.

12. The inclinable seat arrangement of claim 11, wherein said rear roller is movable upwardly on the framework to which it is connected by elastic return means adapted to press it onto the ground at least when the arrangement tends to tip over toward the rear about the central axis.

13. An inclinable seat arrangement comprising a framework arranged to rest on the ground, a seat mounted on the framework by at least one articulation with a horizontal transverse axis so as to be inclinable in a range of inclined positions, and positioning means arranged for stabilizing the seat in at least one of said positions when the seat supports the weight of an occupant, wherein said positioning means include manually controlled blocking means for blocking the inclination of the seat in every/position within said range, and elastic means for coupling the seat to the framework and arranged to exert a return couple on the seat, wherein said elastic means comprise at least one elastic bearing forming said articulation and arranged to produce at least a part of said return couple, and wherein said elastic means further comprise a gas thrustor arranged to exert a force between the framework and the seat at a distance from the articulation axis, said force being substantially constant at least when the blocking means are unblocked, and wherein said blocking means are associated with said gas thrustor and arranged so as to block or unblock the gas thrustor upon command.

14. The inclinable seat arrangement of claim 13, wherein the seat is inclinable toward the front and toward the rear relative to a no-load equilibrium position.

15. The inclinable seat arrangement of claim 13, wherein the seat includes a sole plate mounted on the framework and a back support inclinably mounted on the sole plate by another articulation associated with elastic return means for acting on the back support.

16. The inclinable seat arrangement of claim 13, in the form of a wheelchair for the sick or handicapped, wherein the framework includes two principal wheels arranged along a common central axis located proximate a vertical line passing through the common center of gravity of the arrangement and of the occupant, at least one directable front wheel located ahead of the central axis, and at least one rear safety roller arranged so as to bear on the ground at least in the event of tipping over of the arrangement toward the rear about the central axis; said rear roller being movable in height on the framework to which it is connected by an elastic return means adapted to press it onto the ground at least when the arrangement tends to tip over toward the rear about the central axis.

* * * * *